United States Patent [19]

Voelz et al.

[11] 3,989,072

[45] Nov. 2, 1976

[54] NOZZLE SEALING DEVICE AND ASSEMBLY

[75] Inventors: Frederick L. Voelz, Orland Park, Ill.; Peter P. Moskovich, Gary, Ind.; John N. Novick, Chicago, Ill.

[73] Assignee: Atlantic Richfield Company, Philadelphia, Pa.

[22] Filed: Mar. 31, 1975

[21] Appl. No.: 563,881

[52] U.S. Cl. ..... 141/311 R; 277/226

[51] Int. Cl.[2] ..... B65B 3/18

[58] Field of Search ..... 141/1, 5, 52, 59, 97, 141/285, 287, 290, 311, 312, 367, 368, 372, 382–386, 392; 277/34.3, 226, 228

[56] References Cited

UNITED STATES PATENTS

| | | | |
|---|---|---|---|
| 3,147,016 | 9/1964 | Traufler | 277/226 |
| 3,830,267 | 8/1974 | Cass | 141/287 |
| 3,840,055 | 10/1974 | Wostl | 141/52 X |
| 3,899,009 | 8/1975 | Taylor | 141/97 |
| 3,907,010 | 9/1975 | Burtis | 141/52 X |

*Primary Examiner*—Richard E. Aegerter
*Assistant Examiner*—Frederick R. Schmidt
*Attorney, Agent, or Firm*—Thomas J. Clough

[57] ABSTRACT

A sealing device for use with a liquid dispensing nozzle assembly having a nozzle housing with an elongated discharge spout, a flexible vapor collector surrounding the spout with one free end and the other end attached to the nozzle housing or in proximity thereto, and provided with a means to recover vapor during delivery of liquid from the spout to a liquid receiver inlet which includes a mounting means affixed to the free end of the vapor collector, a flexible member with an interior chamber affixed to the mounting means so that it will contact the receiver inlet when the spout is inserted in the receiver inlet, and a fluid material substantially filling the interior chamber of the flexible member and which will allow the flexible member to conform to a geometry of the receiver inlet. Moreover, an improved liquid dispensing nozzle assembly includes a liquid-dispensing nozzle means, a flexible vapor collector means forming a chamber around the upper portion of the nozzle spout, a face means which includes the sealing device located adjacent to one end of the vapor collector for forming a seal with the outer surface of the liquid receiver inlet, and at least two spring members each of which act to extend the flexible vapor collector means, each of these spring members having one end attached to a different point of the face means so that the face means has substantially free rotational movement transverse to the axis of the nozzle spout.

18 Claims, 4 Drawing Figures

NOZZLE SEALING DEVICE AND ASSEMBLY

The present invention relates to a nozzle for dispensing a liquid, and more particularly to a nozzle having means for preventing the escape of vapors during a liquid dispensing operation and a sealing device to hinder vapor escape.

Hydrocarbon based fuel, e.g., gasoline, is normally dispensed through a fuel-dispensing nozzle to, for example, an automobile fuel tank. Often, during this fuel dispensing operation, hydrocarbon vapor escapes from the fuel tank fillpipe. This escaped hydrocarbon may add to the already pressing air pollution problem. Various governmental regulations have been proposed which would require that the escape of both liquid fuel and fuel vapor from vehicles which are being supplied with fuel be controlled and/or minimized.

The prior art has suggested various means of recovering vapors which otherwise would escape to the atmosphere while fuel tanks are being filled. For example, see U.S. Pat. Nos. 3,581,782; 3,566,928; 2,850,049 and 2,908,299. The first of these patents discloses a vapor emission control system suitable for gasoline and other liquid fuel delivery systems, and adapted to reduce the escape of fuel vapors to the atmosphere. The disclosed embodiment of the control system includes, for example, a flexible annular sleeve surrounding the spout or outlet means of the nozzle. During fueling operation, this sleeve is sealed to the fillpipe of the fuel tank by means of an expandible member which, when expanded after the spout is inserted into the fillpipe, reduces the emission of vapor to the atmosphere.

One problem which has occurred in attempting to minimize fuel vapor loss relates to the seal between the fuel-dispensing nozzle assembly and the fuel tank fillpipe. Various means, some of which are disclosed in the patents noted above, have been devised in order to promote an effective nozzle assembly-fillpipe seal. However, in spite of these developments, the problem of improving an effective seal persists.

Another problem with the nozzle assembly-fillpipe seal involves the manual strength required to maintain an effective seal. Often a gasoline service station attendant, after having filled many tanks, will become tired and unable to provide enough force to maintain a proper or effective seal. In addition, many gasoline service stations are being converted to self-service wherein the gasoline consumer himself or herself dispenses fuel. Such consumers often do not have the required strength and/or skill to use the prior art nozzle assemblies and obtain an effective assembly-fillpipe seal. A still further problem involves the position of the fuel tank fillpipe. Automotive fuel tank fillpipes are situated in a great many different positions, some of which are easy and others relatively difficult, if not impossible, to reach with certain prior art vapor recovery nozzle assemblies. Therefore, it would be beneficial to provide an improved fuel-dispensing nozzle assembly and sealing device which provides an easy and effective assembly-fillpipe seal. For example, it would be advantageous to provide an improved vapor recovering, liquid fuel-dispensing nozzle assembly which does not require constant external applied force, e.g., hand holding, to maintain an effective assembly-fillpipe seal with various fillpipes having significantly different positions.

It is therefore, a primary object of the present invention to provide an improved sealing device which can conform to a geometry of the receiver inlet for a vapor recovering, liquid-dispensing nozzle assembly.

It is a further object of the present invention to provide a vapor recovering, liquid-dispensing nozzle assembly and sealing device wherein the seal between the nozzle assembly and the liquid receiver inlet, e.g., automobile fuel tank fillpipe, is improved.

Another object of the present invention is to provide a sealing device and vapor recovering, liquid-dispensing nozzle assembly which is capable of maintaining an effective assembly-liquid receiver inlet seal with receiver inlets having significantly different positions.

It is yet a further object of the present invention to provide a sealing device and improved vapor recovering, liquid-dispensing nozzle assembly which is simple in design and easy to operate.

SUMMARY OF THE INVENTION

The present invention involves a liquid-dispensing nozzle assembly for delivery of liquid from a liquid source to a liquid receiver having a receiver inlet. The assembly is provided with means to minimize escape of vapor, e.g., from the liquid receiver, during delivery of liquid to the receiver inlet from the liquid source.

The present sealing device for use with a liquid dispensing nozzle assembly having a nozzle housing with an elongated discharge spout, a flexible vapor collector surrounding the spout with one free end and the other end attached to the nozzle housing or in proximity thereto, and provided with a means to recover vapor during delivery of liquid from the spout to a liquid receiver inlet which comprises:

a mounting means affixed to said free end of said vapor collector;

a flexible member with an interior chamber affixed to said mounting means so that it will contact said receiver inlet when said spout is inserted in said receiver inlet; and a fluid material substantially filling said interior chamber of said member and which will allow said flexible member to conform to a geometry of said receiver inlet within a period of time up to about 30 seconds after said flexible member is urged against said receiver inlet.

Moreover, a preferred liquid-dispensing nozzle assembly, which is useful in conjunction with a liquid receiver having a liquid receiver inlet, comprises:

a liquid-dispensing nozzle means having a nozzle inlet, a nozzle housing and an elongated nozzle outlet or discharge spout adapted for insertion into the liquid receiver inlet;

a flexible vapor collector means surrounding, in spaced relation thereto and forming a chamber therearound, the upper portion of the spout nearest the nozzle housing for receiving vapors from the liquid receiver, the chamber being in fluid communication with the receiver inlet when liquid is being delivered through the liquid receiver inlet, one end of the vapor collector being attached to the nozzle housing;

a face means located adjacent to the second end of the vapor collector away from the end attached to the housing, the spout of the nozzle means extending beyond the second end of the vapor collector means when liquid is being delivered through the liquid receiver inlet;

a flexible member with an interior chamber affixed to said face means so that it will contact said receiver inlet when said spout is inserted in said receiver inlet;

a fluid material substantially filling said interior chamber of said member and which will allow the flexible member to conform to a geometry of said receiver inlet within a period of time of up to about 30 seconds after said flexible member is urged against said receiver inlet; and at least two spring members, preferably located at least partially inside the outer surface of the vapor collector and more preferably located essentially totally inside the outer surface of the vapor collector, each of which acting to extend the flexible vapor collector means, each of these spring members having one end attached to a different point of the face means so that the face means has substantially free rotational movement transverse to the axis of the spout. Outstanding results, e.g., improved liquid-dispensing nozzle assembly-liquid receiver inlet seal effectiveness and reduced vapor loss, can be obtained using the present sealing device or liquid-dispensing nozzle assembly.

The substantially free rotational movement noted above refers to interplanal, rather than intraplanal, rotational motion. Of course, this type of rotational movement transverse to the axis of the spout is limited in that as the face means rotates, it eventually comes in contact with the spout itself. This substantially free rotational movement of the face means of the present apparatus provides for effective and efficient face means-liquid receiver inlet seals even though the positions of various receiver inlets differ significantly.

In a preferred embodiment, the present liquid-dispensing nozzle assembly further comprises at least one latch means located adjacent to the spout for automatically, i.e., without hand holding, maintaining the spout in the liquid receiver inlet after insertion. In an additional preferred embodiment, the sealing device of the present apparatus includes a compressible cellular elastomer material, such as a foamed synthetic resin, which is carried by, attached or secured in a manner, such that the compressible material overlays the flexible member and comes in contact with the liquid receiver inlet during liquid dispensing operations. The presence of such material acts to further improve the seal between the nozzle assembly and receiver inlet.

The apparatus of the present invention may be fabricated from any suitable material or materials of construction. The materials of construction used are dependent upon the particular application involved. In many instances, metals and metal alloys such as aluminum, iron, carbon steel or stainless steel, copper and the like may be used to construct the liquid dispensing nozzle of the present apparatus. Various organic polymers, e.g., polyethylene, polypropylene, polychloroprene, nylon, natural rubber and the like, may be used to construct the flexible vapor collector. Of course, the apparatus should be made of materials which are substantially unaffected by the liquid dispensed and the conditions, e.g., temperature, pressure and the like, at which the apparatus is normally operated. In addition, such materials should have no substantial detrimental effect on the liquid being dispensed.

These and other aspects and advantages of the present invention are set forth in the following detailed description and claims, particularly when considered in conjunction with the accompanying drawings in which like parts bearing like reference numerals are listed

DETAILED DESCRIPTION OF THE INVENTION

Figures 1, 2, 3, 4:
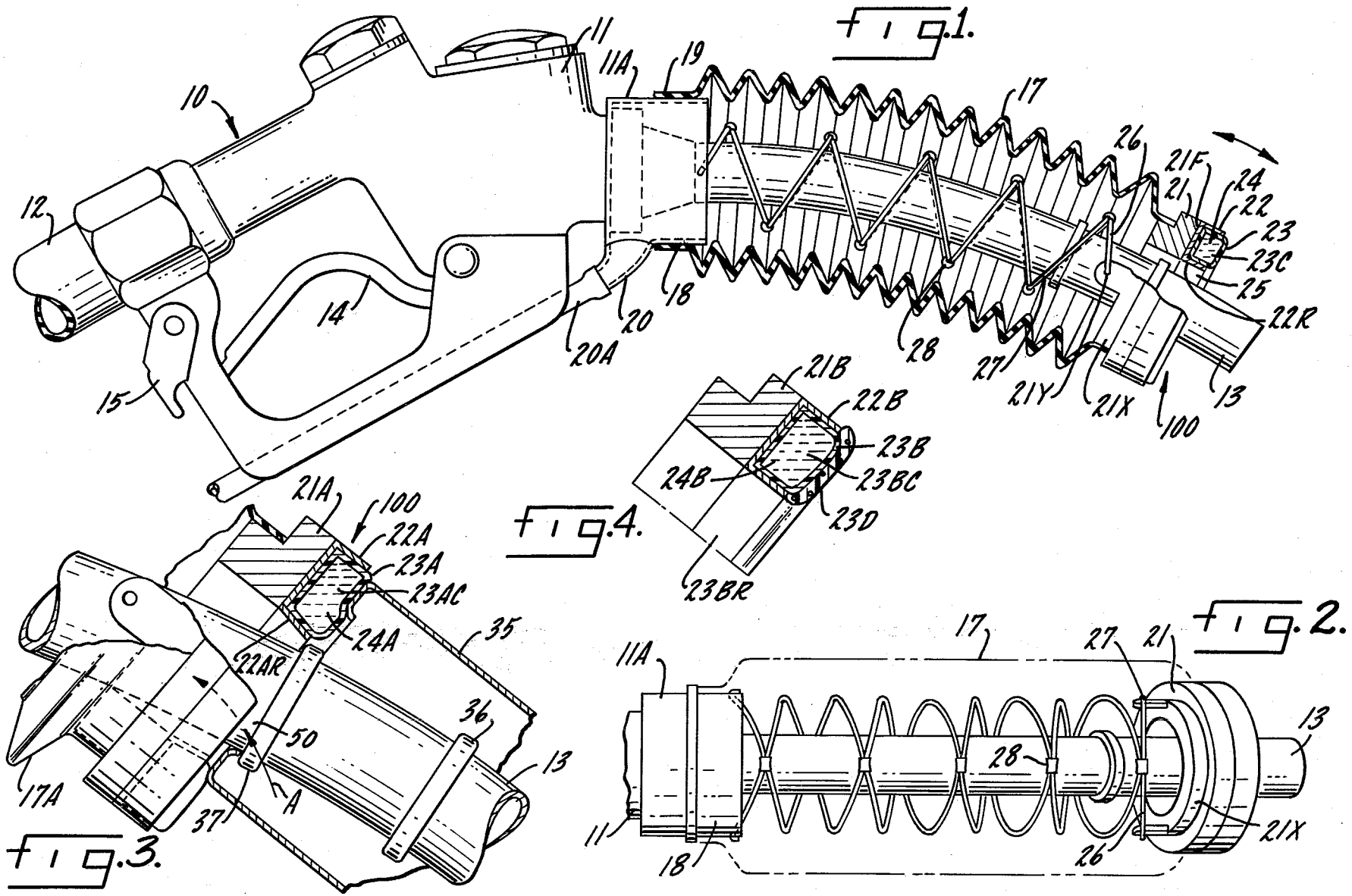
FIG. 1 is a side view, partly in section, of the improved liquid-dispensing nozzle assembly including a sealing device of the present invention.
FIG. 2 is a partial top view of the improved liquid-dispensing nozzle assembly including a sealing device of the present invention shown in FIG. 1.
FIG. 3 is an enlarged view, partly in section, of an additional embodiment of the improved liquid-dispensing nozzle assembly including a sealing device of the present invention inserted into a fillpipe of an automobile fuel tank; and, FIG. 4 is a sectional view of another embodiment of a sealing device of the instant invention.

While the present invention is applicable to all liquid-dispensing nozzles, the present liquid-dispensing nozzle assembly is particularly useful with conventional liquid fuel nozzles, more particularly with hydrocarbon fuel, e.g., gasoline, nozzles. Therefore, the present invention will be described with reference to such liquid fuel dispensing nozzles, although those skilled in the art will realize that the invention generally is applicable to a much broader field.

The liquid fuel-dispensing nozzle of the present invention has a main body or housing having an integral handle, a fuel inlet, which normally comprises a flexible conduit means communicating between the source of fuel, such as an underground storage tank, and an elongated fuel outlet or discharge spout which is adapted for insertion into the liquid receiver inlet, e.g., fillpipe, of the fuel tank. At least one latch means is preferably provided, e.g., welded, screwed or bolted, around a major portion of the discharge spout. Such latch means assist in automatically maintaining the spout in the fillpipe during the liquid fuel dispensing operation. Such latch means are particularly useful in self-service, liquid fuel dispensing operations.

The present apparatus involves a flexible vapor collector means, such as a flexible bellows. One end of the bellows is attached, e.g., adhesively sealed and/or clamped or otherwise mechanically or chemically attached, to the housing at the upper end of the spout. The second end or free end of the bellows is located adjacent to the face means and may be attached, e.g., adhesively sealed and/or clamped or otherwise mechanically attached, to the face means or mounting means. As the spout is inserted into the liquid receiver inlet, e.g., fillpipe, the flexible vapor collector means tends to become compressed and the sealing device, preferably the flexible member, with or without the compressible cellular plastic material, forms a seal with the outer surface of the fillpipe. The plurality of spring members attached at different points to the face means or mounting means act to extend the flexible vapor collector means. In other words, each of these spring members pushes and holds the sealing device of the present apparatus in contact with the fuel tank fillpipe seal.

Referring now to FIG. 1, a gasoline-dispensing nozzle is shown which is provided with vapor recovery means. More specifically, a nozzle, generally designated 10, comprises a main body or housing 11, an inlet conduit 12 and a discharge spout 13. A handle 14 is provided for actuating the delivery of gasoline or other fuel. In addition, and as in conventional, a retainer means 15 is also provided on the main body of the housing 11 for holding the handle 14 in its fuel-delivery position. It is also conventional to provide such nozzles with means for automatically shutting off delivery of fuel when the fuel tank is full. Such means are not shown in FIG. 1, but may include, for example, an orifice near the termination of the spout 13, and a tube communicating from the orifice to a control mechanism within the housing 11 of the nozzle 10, wherein the control mechanism, sensing the presence of a gas or liquid near the orifice, acts to disengage handle 14 from retainer 15 thereby automatically stopping delivery of fuel through the nozzle 10.

Spout 13 is surrounded by flexible vapor collector means which may take the form of a flexible bellows 17. The upper end 19 of bellows 17 is adhesively sealed to surface 18 of collar member 11A of the nozzle 10. The opposite second end or free end of bellows 17 is adhesively sealed to annular extension 21X of heel portion 21 which has a substantially flat face 21F. Sealing device 100 is conveniently attached to heel portion 21. Mounting means 22 is affixed to heel portion 21. Mounting means 22 forms a cavity which is essentially open only on the side which will contact a liquid receiver surface. Mounting means 22 can be rigid material but is preferrably a semi-rigid material. Thus when the interior wall 22R of mounting means 22 is forced against spout 13, it may slightly flex. In another embodiment, the interior wall 22R is made of a semi-rigid material while the rest of mounting means 22 is made of a rigid material. Some examples of rigid materials are metals such as aluminum, or hard plastics. Some semi-rigid materials are rubbers or polymers compounded so as to allow the material to flex up to about one half inch per inch of length. By the term mounting means is meant that it is capable of retaining the flexible member 23 when it is affixed to the mounting means. Thus the mounting means should have a geometric configuration which allows for the pressure of the flexible member 23 to be directed in the direction of the spout when it makes contact with the receiver inlet. For example, the cavity of mounting means 22 substantially restrains the flexible member from movement toward the spout, away from the spout and toward the heel portion 21 while directing movement toward the fillpipe when forces are built up during contact of the flexible member 23 with the fillpipe. A flexible member 23 is affixed in the cavity of mounting means 22. The flexible member 23 includes an interior chamber 23C. Flexible member 23 is made from a flexible material impervious to the particular fluid 24 used such as rubbers derived from epichlorohydrin, fluoro-hydro carbons, aluminosilicates; polyacrylate elastomers, nitrile elastomers, polytetrafluoroethylene, polychloroprene, polyolefin, polyvinyl chlorides, ureathane, urea-formaldehyde resins and mixtures thereof. Chamber 23C is substantially filled with a fluid 24 which will allow flexible member 23 to conform to a geometry of a receiver inlet within a period of time of up to about thirty seconds after flexible member is urged against a receiver inlet. In a preferred embodiment, the fluid will allow conformation in up to about 15 seconds and in another preferred embodiment in up to about 5 seconds. Some examples of fluids are silicone rubbers, viscous liquids in oils, and compressed nitrogen or air. Since the fluid filled chamber 23C imparts a cushioning layer to the flexible member 23, flexible member 23 may be constructed of a thinner tougher material then if there was no cushioning layer. For example, if a particular sealing material were attached to a rigid backing, the maximum conforming action would be substantially the thickness of the layer of sealing material, assuming the material could be completely compressed in use. However, in the instant invention, the conforming action can also take place in the fluid, so the conforming action of the sealing device may be much greater then thickness of the flexible member. Moreover, this instant cushioning effect provides a protection against cutting and wear by not allowing the sealing material of the sealing device to absorb the full impact of the cutting object. Typically, flexible member has a thickness less than about three-sixteenths of an inch, more preferrably less than about one-eight of an inch and still more preferrable less than about one-sixteenth of an inch. Of course, the thickness will vary according to the inherent flexibility and abrasion resistance of the material used for the flexible member.

Heel portion 21 and sealing device 100 are both substantially annular in shape providing a space 25 between wall 22R, heel portion 21 and the outside surface of spout 13 thereby allowing vapors escaping from the fillpipe to pass between heel portion 21 and spout 13 and into the interior of bellows 17. An aperture 20 is conveniently provided near the upper end of the bellows 17 for removal of vapors. The means for removing the vapors from aperture 20 may comprise, for example, a conduit 20A attached to aperture 20, the conduit 20A providing fluid communication with, for example, a combustion means whereby the vapors may be stored to await further processing. In addition, the hydrocarbons in the vapors may be recovered by other suitable means such as by adsorption or condensation.

Heel portion 21 includes an annular extension 21X which extends from heel portion 21 toward bellows 17. Extension 21X includes, for example, two substantially opposing apertures 21Y therethrough. Each of these apertures 21Y in extension 21X is used to secure one end of spring members 26 and 27 to heel portion 21 so as to provide heel portion 21 with substantially free rotational movement transverse to the axis of spout 13. The other end of each spring member 26 and 27 is attached, e.g., welded, adhesively bound and/or otherwise mechanically attached, to collar member 11A of nozzle 10. Each of spring members 26 and 27 acts to extend bellows 17. Thus, with reference now to FIGS. 1 and 3, as spout 13 is inserted to fillpipe 35 and bellows 17 tends to compress, spring memebers 26 and 27 act to force heel portion 21 and sealing device 100 onto fillpipe 35, thus providing an improved seal between fillpipe 35 and heel portion 21. Fasteners 28, e.g., strips of tape, may be used at the points of inter-section of spring members 26 and 27 to hold the spring members together at these points.

FIG. 4 shows an alternate embodiment of the instant invention, wherein a substantially flexible member as in the embodiment shown in FIG. 1 has a surface face of compressible cellular plastic material 23D attached to it, e.g., adhesively bound, to the outside of flexible member 23B.

The face portion 21B, mounting means 22B, flexible member 23B with an interior chamber 23BC filled with fluid 24B are similar in construction to the other embodiments of the invention.

In a preferred embodiment of the present invention, more than one, preferably two, spring members, e.g., such as spring members 26 and 27, acting to extend bellows 17 be attached to different points, preferrably substantially opposing points, of the face means. By attaching more than one such spring members to different points of the face means of the present apparatus, the face is provided with substantially free rotational movement transverse to the axis of spout 13.

Spring members 26 and 27 may be constructed of any suitable material or materials of construction. In many instances, metal and metal alloys such as aluminum, iron, carbon steel, or stainless steel, copper and the like may be used to construct these spring members. Of course, these spring members should be made of materials which are substantially unaffected by the liquid being dispensed and the conditions, e.g., temperature, pressure, and the like, at which the present apparatus is normally operated. In addition, the materials of construction should have no substantial detrimental effect on the liquid being dispensed.

The particular configuration of these spring members is not critical to the present invention. For example, the springs may have substantially the same or different sized spirals, and may have any suitable cross-section, e.g., square, circular and the like. In one preferred embodiment, at least one of the spring members is reverse wound. The spring members should have sufficient strength so that they act to extend the flexible vapor collector and provide an improved seal between the face means of the present apparatus and the receiver inlet. Preferably, each of these spring members exerts a force in the range from about 2 foot-pounds to about 25 foot-pounds, more preferably from about 3 foot-pounds to about 13 foot-pounds.

As seen in FIG. 3, flexible member 23A comes into contact with the fillpipe 35. More specifically, referring to FIG. 3, spout 13 is shown inserted into a fillpipe 35, the upper portion of the latter contracting flexible member 23A thereby forming a seal against vapor escape. The spout 13 is shown as being provided with two latching means 36 and 37 which assist in maintaining the spout 13 in the fillpipe 35 during the filling operation. Latching means 36 and 37 are attached, e.g., bolted, to spout 13. In operation, as the spout 13 is inserted into the fillpipe 35, latch means 37 (or 36) acts to retain the spot 13 in fillpipe 35. As the spout 13 is inserted into the fillpipe 35, bellows 17 tends to become compressed and the spout 13 is retained in fillpipe 35 by latch means 37 (or 36), flexible member 23A tightly seals the fillpipe 35 against possible vapor loss. Vapors which leave fillpipe 35 pass through space 50, for example by a path shown by arrow A, into the interior of bellows 17 from which they are removed through aperture 20 (see FIG. 1).

Compressible cellular plastic material 23D may be secured to any part of the face means, for example flexible member 23B, mounting means 22B, the heel 21B or bellows by any suitable means, for example, an epoxy-type cement can be employed for this purpose, but those skilled in the art will realize that any suitable adhesive means may be employed for this purpose. In the embodiment shown in FIG. 1, heel portion 21, mounting means 22, flexible member 23, and fluid 24, together make up the face means of the present apparatus. Of course, the flexible bellows, flexible member and mounting means are formed of materials which are substantially resistant to the fuel liquid and vapor being processed. For example, the bellows may be comprised of a flexible polychloroprene rubber, such bellows being commercially available.

The compressible cellular plastic material 23D is defined as a cellular plastic material which is compressible under a normal load (in psi.) obtained when the compressible cellular plastic material 23D contacts the fillpipe 35 during the dispensing of fuel. The term "compressible" is used in its normal dictionary sense and includes materials which deform to a certain extent when the spout 13 of the nozzle 10 is inserted into the fillpipe 35, thereby providing an extremely good seal against vapor escape. Typically, the compressible cellular plastic material 23D is compressed under such normal load in the range of from about 5 to about 85 percent, more preferably from about 25 to about 70 percent, based upon the original volume of material. Examples of the compressible cellular plastic material 23D include the cellular material (i.e., foams, sponges) obtained from polychloroprene latex, polyolefin, e.g., polyethylene, polypropylene, mixtures thereof and the like, silicone, urethane polymer, polyvinyl chloride, polytetrafluoroethylene, cellulose acetopropionate, urea-formaldehyde resin, fluorinated elastomers, polyacrylic elastomers, epichlorohydrin elastomers, nitrile elastomers and mixtures thereof. Particularly preferred compressible cellular plastic materials 23D are polyacrylic elastomers, epichlorohydrin elastomers and fluorinated elastomers. As stated above, such compressible cellular plastic material 23D should be substantially resistant toward the fuel liquid being dispensed and the corresponding vapor, particularly when such fuel is gasoline.

As noted above, the exposed surface of the compressible cellular plastic material 23D can be coated with a coating of the same plastic material used to form the cellular plastic material 23D. Thus, the exposed surface of material 23D can have a coating which contacts the receiver inlet, e.g., fillpipe 35, to which liquid is being dispensed. In addition, the exposed face of the compressible cellular plastic material 23D can have a coating which is of a different material, such as a synthetic resinuous material or a natural occurring material, both of which are substantially resistant to the liquid fuel being dispensed and the vapor being collected. The coating, either the same or different from the compressible cellular plastic material 23D, has to be resilient, that is, the material deforms to a certain extent when the spout 13 of nozzle 10 is inserted into fillpipe 35. Typical examples of resilient material are leather and synthetic resins, such as listed in the prior paragraph. It is contemplated within the scope of this invention that the term "compressible cellular plastic material" includes: such protective coating of resilient material attached to the exposed surface of compressible cellular plastic material.

The thickness of the compressible cellular plastic material is not critical and may vary from a minimum thickness required to provide an effective nozzle assembly-receiver inlet seal to the maximum thickness which is dictated by economic consideration, i.e., an extremely thick material would not be required. Preferably, the thickness of the compressible cellular plastic material 23D ranges from about 1/16 inch to about ½ inch. When a cellular plastic material 23D is utilized, the flexible member may be made thicker since the overlay of cellular material 23D will provide additional conforming action.

The following example illstrates more clearly the apparatus and method of the present invention. However, this illustration is not to be interpreted as specific limitations on this invention.

EXAMPLE I

A vapor recovery gasoline dispensing nozzle according to the present invention is constructed similarly to the nozzle depicted in FIGS. 1 and 2. Each of the two spring members in the bellows is attached to different, essentially opposing, points of the heel portion of the face means to provide the face means with substantially free rotational movement transverse to the axis of the outlet spout. Since both spring members are attached to the heel portion of the face means, the face means of this nozzle has significantly improved rotational freedom. Thihs increased freedom of motion allows the nozzle of the present invention to effect a vapor tight seal with fillpipes. A mounting means, containing a flexible member filled with a fluid is adhesively bound to the heel portion of the face means to come in contact and provide a seal with the fillpipe.

Once the apparatus is inserted and latched into the fillpipe, fueling proceeds without hand holding. Of course, the fuel tank fillpipes on many of the vehicles fueled using this nozzle assembly are located in various differing positions.

In addition, the fillpipes can have dents and therefore do not present a uniform surface. The nozzle assemblies of the present invention, due to the direction of forces towards the fillpipe and the ability of the flexible member to conform to the surface of the fillpipe, provides for improved sealing and therefore improved recovery of vapor during dispensing of fuel.

This example clearly illustrates the outstandingly improved results obtainable with the present apparatus. For example, the sealing device and/or plurality of spring members attached to different points of the face means and acting to extend the vapor recovery means and face means onto the fillpipe are unexpectedly more effective for forming a seal. In addition, since the face means of the present apparatus is an integral part of the present apparatus, being attached to the plurality of spring members, the position of the face means can be adjusted substantially to a considerable degree. This feature allows the present apparatus to be compatible, e.g., effect a vapor tight nozzle-fillpipe seal, in substantially more instances, e.g., with fillpipes having significantly differing positions. Moreover, the sealing device of the instant invention can seal even badly dented fillpipes.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A sealing device for use with a liquid dispensing nozzle assembly having a nozzle housing with an elongated discharge spout, a flexible vapor collector surrounding the spout with one free end and the other end attached to the nozzle housing or in proximity thereto, and provided with a means to allow for vapor removal during delivery of liquid from the spout to a liquid receiver inlet which comprises:

face means carried by the free end of said vapor collector for forming a surface seal against the outer surface of said receiver inlet, provided that said spout extends beyond said face means of said vapor collector;

said face means including mounting means located adjacent to said free end of said vapor collector and a flexible member adjacent thereto having an interior chamber, said mounting means and flexible member cooperating to urge said face means against said receiver inlet when said spout is inserted into and said face means contacts said receiver inlet; and a fluid material substantially filling said interior chamber of said flexible member which allows the flexible member to conform to the geometry of the outer surface of said receiver inlet within a period of time of up to about 30 seconds after said face means is urged against said receiver inlet, retains its fluidity after removal of the spout from the receiver inlet and will provide for pressure redistribution within the flexible member to substantially equalize the pressure against the outer surface of the receiver inlet when the spout and the receiver inlet are not axially aligned at the face means receiver inlet interface, during such contact.

2. A sealing device as in claim 1 wherein said flexible member conforms within about 15 seconds.

3. A sealing device as in claim 1 wherein said flexible member conforms within about 5 seconds and the fluid is an oil.

4. A sealing device as in claim 1 wherein the exposed face of the face means comprises a compressible cellular plastic material and the liquid is a fuel.

5. A sealing device as in claim 4 wherein the compressible cellular plastic material comprises a polymer selected from the group consisting of polyolefin, polychloroprene latex, silicone, urethane polymer, poly (vinyl chloride), polytetrafluoroethylene, cellulose acetopropionate, fluorinated elastomers, polyacrylic elastomers, nitrile elastomers, epichlorohydrin elastomers, and urea-formaldehyde resin.

6. A sealing device as in claim 5 wherein the compressible cellular plastic material comprises a polymer selected from the group consisting of fluorinated elastomers, nitrile elastomers, epichlorohydrin elastomers and polyacrylic elastomers and the material is compressible under normal loads in the range of from 5 to 85 percent of its original volume.

7. A sealing device as in claim 6 wherein the compressible cellular plastic material is obtained from a epichlorohydrin containing elastomer.

8. A liquid dispensing nozzle assembly for delivery of liquid from a liquid source to a liquid receiver having a receiver inlet, said assembly being provided with means to allow for the removal of vapor during delivery of liquid to said receiver inlet from said source, said nozzle assembly comprising:

a liquid dispensing nozzle having a nozzle inlet, a nozzle housing and an elongated discharge spout adapted for insertion into said receiver inlet;

a flexible vapor collector surrounding, in spaced relation thereto and forming a chamber therearound, the upper portion of said spout nearest said nozzle housing, said chamber being in fluid communication with said receiver inlet during said liquid delivery, one end of said vapor collector being attached to said nozzle housing or in proximity thereto;

a face means located adjacent to the second end of said vapor collector away from said end attached to said housing for forming a surface seal against the outer surface of said receiver inlet, provided that said spout extends beyond said face means of said vapor collector;

said face means including mounting means located adjacent to said free end of said vapor collector and a flexible member adjacent thereto having an interior chamber, said mounting means and flexible member cooperating to urge said face means against said receiver inlet when said spout is inserted into and said face means contacts said receiver inlet; and a fluid material substantially filling said interior chamber of said flexible member which allows the flexible member to conform to the geometry of the outer surface of said receiver inlet within a period of time of up to about 30 seconds after said face means is urged against said receiver inlet, retains its fluidity after removal of the spout from the receiver inlet and will provide for pressure redistribution within the flexible member to substantially equalize the pressure against the outer surface of the receiver inlet when the spout and the receiver inlet are not axially aligned at the face means receiver inlet interface durind such contact.

9. The apparatus of claim 8 which has at least two spring members acting to extend said vapor collector means, each of said spring members having one end attached to a different point of said face means so that said face means has substantially free rotational movement transverse to the axis of said spout.

10. The apparatus of claim 9 wherein said face means comprises a heel portion to different points on which one end of each of said spring members is attached and a compressible cellular plastic material attached to said heel portion, said material coming in contact with said liquid receiver inlet during said liquid dispensing.

11. The liquid dispensing nozzle assembly of claim 9 wherein said spring members number two and one end of each of said spring members is attached to essentially opposing points of said face means.

12. The apparatus of claim 9 wherein each said spring member exerts a force in the range from about 2 foot-pounds to about 25 foot-pounds.

13. The apparatus of claim 8 which further comprises at least one latch means located adjacent to said spout for automatically maintaining said spout in said liquid receiver inlet after insertion and the liquid is a fuel.

14. The apparatus of claim 8 wherein the exposed face of the face means comprises a compressible cellular plastic material to said heel portion over said flexible member, said material coming in contact with said liquid receiver inlet during said liquid and the liquid is a fuel.

15. A liquid dispensing nozzle assembly of claim 14 wherein said compressible cellular plastic material comprises a polymer selected from the group consisting of polyolefin, polychloroprene latex, silicone, urethane polymer, poly(vinyl chloride), polytetrafluoroethylene, cellulose acetopropionate, florinated elastomers, polyacrylic elastomers, nitrile elastomers, epichlorohydrin elastomers, and urea-formaldehyde resin.

16. The liquid dispensing nozzle assembly of claim 8 wherein said flexible vapor collector comprises a flexible bellows and the liquid is a fuel.

17. A liquid-dispensing nozzle assembly as in claim 8 wherein said flexible member conforms within about 15 seconds.

18. A liquid dispensing nozzle assembly as in claim 8 wherein said flexible member conforms within about 5 seconds and the fluid is an oil.

* * * * *

UNITED STATES PATENT AND TRADEMARK OFFICE

CERTIFICATE OF CORRECTION

PATENT NO. : 3,989,072

DATED : November 2, 1976

INVENTOR(S) : Frederick L. Voelz, et al

It is certified that error appears in the above-identified patent and that said Letters Patent are hereby corrected as shown below:

Claim 14:
Column 12, lines 17 to 19 delete the phrase "to said heel portion over said flexible member, said material coming in contact with said liquid receiver inlet during said liquid"

Signed and Sealed this

Twenty-second Day of February 1977

[SEAL]

*Attest:*

RUTH C. MASON
*Attesting Officer*

C. MARSHALL DANN
*Commissioner of Patents and Trademarks*